United States Patent [19]

Allen

[11] Patent Number: 4,547,009

[45] Date of Patent: Oct. 15, 1985

[54] STRIKE PLATE AND HINGE FOR A HIGH SECURITY DOOR SYSTEM

[76] Inventor: Mark L. Allen, 1776 E. 13th St., Brooklyn, N.Y. 11229

[21] Appl. No.: 522,325

[22] Filed: Aug. 11, 1983

[51] Int. Cl.[4] ..... E05C 21/00

[52] U.S. Cl. ..... 292/346; 16/251; 292/340

[58] Field of Search ..... 292/340, 346, 339, 338, 292/251

[56] References Cited

U.S. PATENT DOCUMENTS 132,922 11/1872 Pharo ..... 292/339
4,186,954 2/1980 Detlefs ..... 292/340
4,189,175 2/1980 Paxton ..... 292/346 X
4,415,191 11/1983 Thorp ..... 292/340 X

FOREIGN PATENT DOCUMENTS 1424827 2/1976 United Kingdom ..... 292/346

*Primary Examiner*—Richard E. Moore
*Attorney, Agent, or Firm*—William P. Keegan

[57] ABSTRACT

An improved strike plate for mounting on a door jamb to receive the dead bolt of a door mounted lock wherein the strike plate is provided with a buck pin that is offset from the bolt receiving aperture of the plate so as to be insertable in an opening provided in the strongest part of the wall supporting structure. A hinge similarly constructed is also disclosed.

3 Claims, 15 Drawing Figures

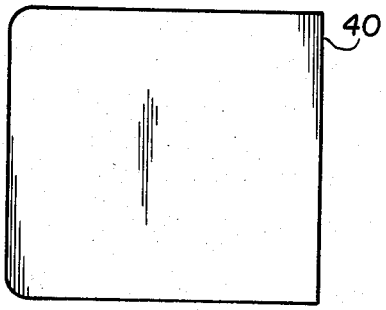
FIG.5
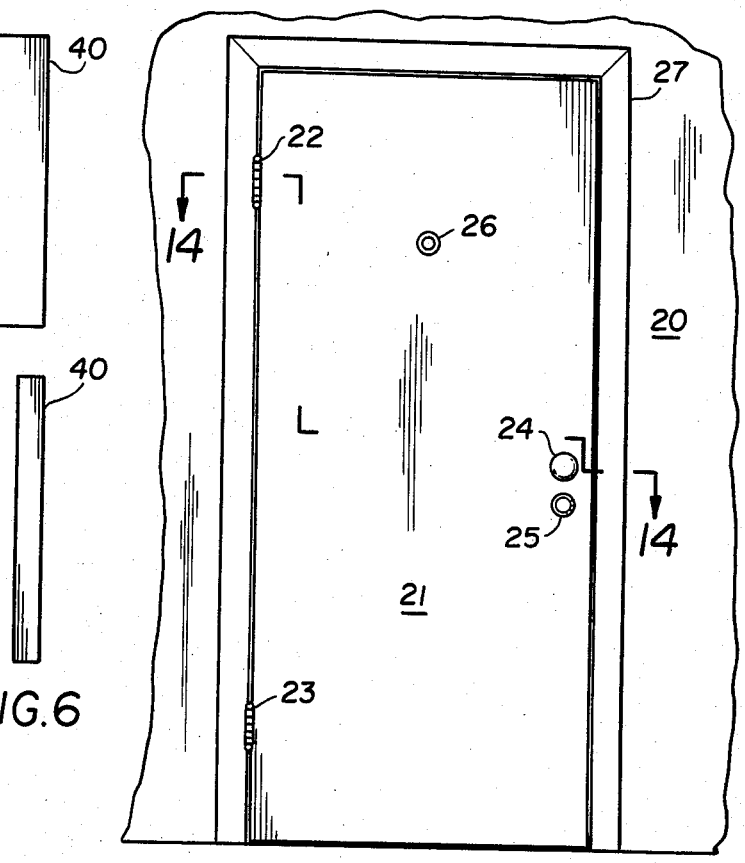
FIG.1
FIG.6
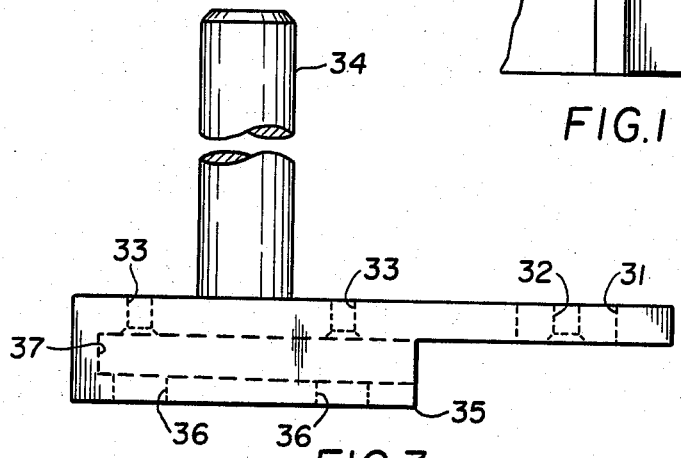
FIG.3
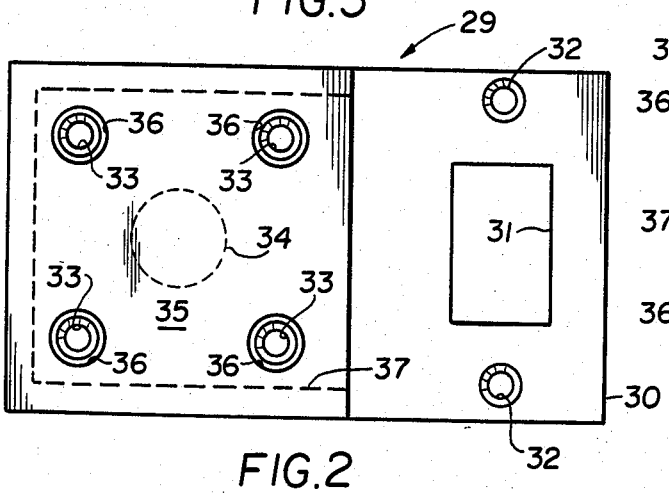
FIG.2
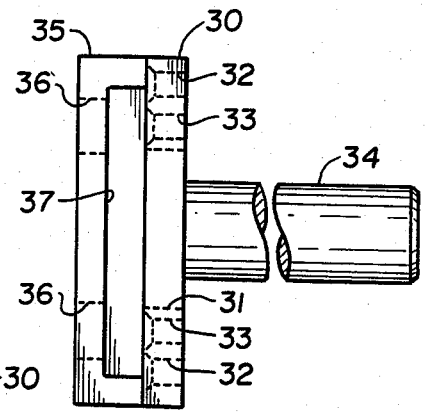
FIG.4

STRIKE PLATE AND HINGE FOR A HIGH SECURITY DOOR SYSTEM

FIELD OF THE INVENTION

This invention relates to a door security system, and more particularly to an improved strike plate for reciving the dead bolt of a lock mounted in an exterior door, and to an improved hinge by which the door is hung in a door frame.

BACKGROUND OF THE INVENTION

With the increased need and demand for securing exterior doors against unauthorized and forcible entry, there has been a steady development of improved security locks. Such improvements have been directed to pick resistant cylinders, longer and stronger dead bolts, and guard plates to prevent removal of lock cylinders. However, no matter how secure the lock cylinder and bolt are, the fact remains that the bolt generally extends only about one inch into an aperture in the door jamb after passing through a small strike plate mounted on the jamb. The strike plate is usually secured to the jamb by a pair of screws that extend a small distance into the jamb. Moreover, the location of the strike plate and the aperture into which the lock bolt extends is close to the inner edge of the jamb with a relatively thin section of the jamb retaining the bolt against inward movement. Thus, in many instances, a person may cause the bolt to rip through the retaining section of the jamb simply by throwing his weight against the door. In this way entry may be gained without disturbing or overcoming the security offered by the lock itself. Efforts have been made to strengthen strike plates. See, for example, U.S. Pat. Nos. 4,005,890 and 4,186,954.

Also, since the dead bolt generally extends only about an inch into the door jamb, and the jamb often is only a framing member spaced from the two by four's that form the basic wall structure, the door jamb can be sprung with a crowbar and pried away from the extended bolt. It is even known that hydraulic jacks have been used to spread the door jambs to disengage the jamb and strike plate from the extended dead bolt. The same techniques can be used to free the door at its hinge side since the hinges are secured near the inner edge of the door jamb by relative short screws.

BRIEF DESCRIPTION OF THE INVENTION

It is an object of the invention to provide an improved door security system.

It is another object of the invention to provide an improved strike plate that resists being ripped from the door frame to which it is attached.

It is still another object of the invention to provide a strike plate that strengthens the door jamb against a force that acts to pry or spring the jamb away from the door.

It is yet another object of the invention to provide an improved door hinge that will enhance the security offered by a locked door.

In carrying out the invention, a strike plate that extends outside the area protected by a closed door is provided with an integral elongated buck pin tht extends into the door jamb and into an abutting relationship with the central section of the basic wall structure. A hinge with a similar buck pin is also provided.

Features and advantages of the invention may be gained from the foregoing and from the description of a preferred embodiment of the invention which follows.

DESCRIPTION OF THE DRAWING

FIG. 1 is an elevational view of a typical apartment entry door viewed from inside the apartment;

FIG. 2 is a front elevational view of a strike plate according to the present invention;

FIG. 3 is a top plan view of the strike plate;

FIG. 4 is a side elevational view of the strike plate;

FIGS. 5 and 6, respectively, are front and side elevational views of a security plate used in conjunction with the strike plate;

DETAILED DESCRIPTION OF THE INVENTION

Figure 8:
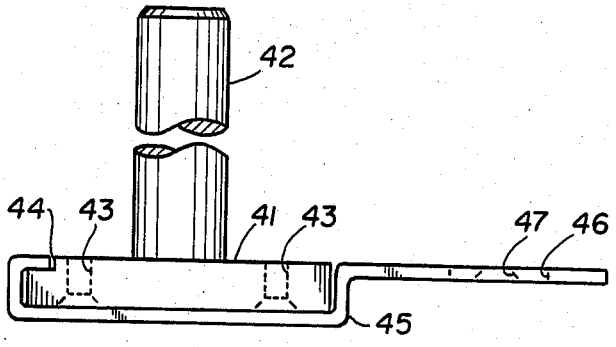
FIG. 8 is a top plan view of the strike plate of FIG. 7.

Referring to FIG. 1 of the drawing, a typical apartment entry door 21 is shown as viewed from the interior of the apartment. Door 21 is an inwardly swinging door supported by an upper hinge 22 and a lower hinge 23. A door knob 24 operates the usual latch while key cylinder 25 controls the dead bolt used to securely lock the door against unauthorized entry. A peep hole viewer 26 enables the occupant of the apartment to see into the hallway outside the apartment so as to identify anyone who might be signalling for entrance. A decorative molding 27 may be provided.

As previously noted, the security afforded by door 21 depends to a great extent (omitting consideration of cylinder 25) on the dead bolt actuated by cylinder 25 extending into the door jamb and the screws securing hinges 22 and 23 to the opposite door jamb. The dead bolt extends through a strike plate mounted on the face of the door jamb about an inch into the door jamb itself. The point at which the dead bolt enters the door jamb is relatively near the inner edge of the jamb adjacent molding 27. Similarly, the screws securing hinges 22 and 23 to the door jamb do not extend too far into the jamb nor are they far from the inner edge thereof. The arrangement is such that a violent force applied against the outside of door 21 can cause the dead bolt or the hinge screws to tear through the relatively thin section of the door jamb opposing such a force.

A strike plate and a hinge of the type disclosed herein will substantially improve the security offered by the typical entry door.

Figure 13:
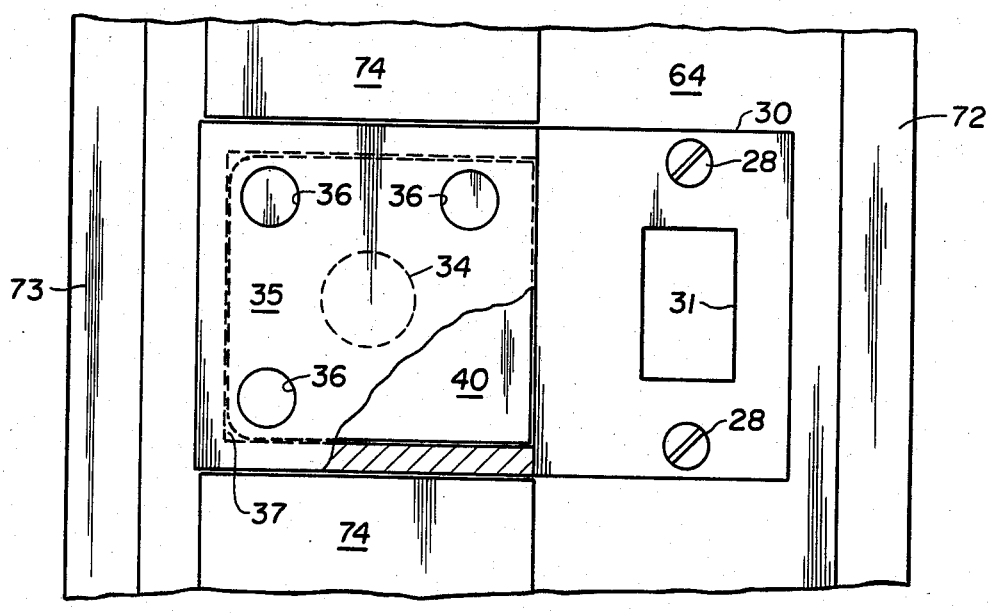
FIG. 13 is a front elevational view showing the improved strike plate mounted on a door jamb.
Figure 14:
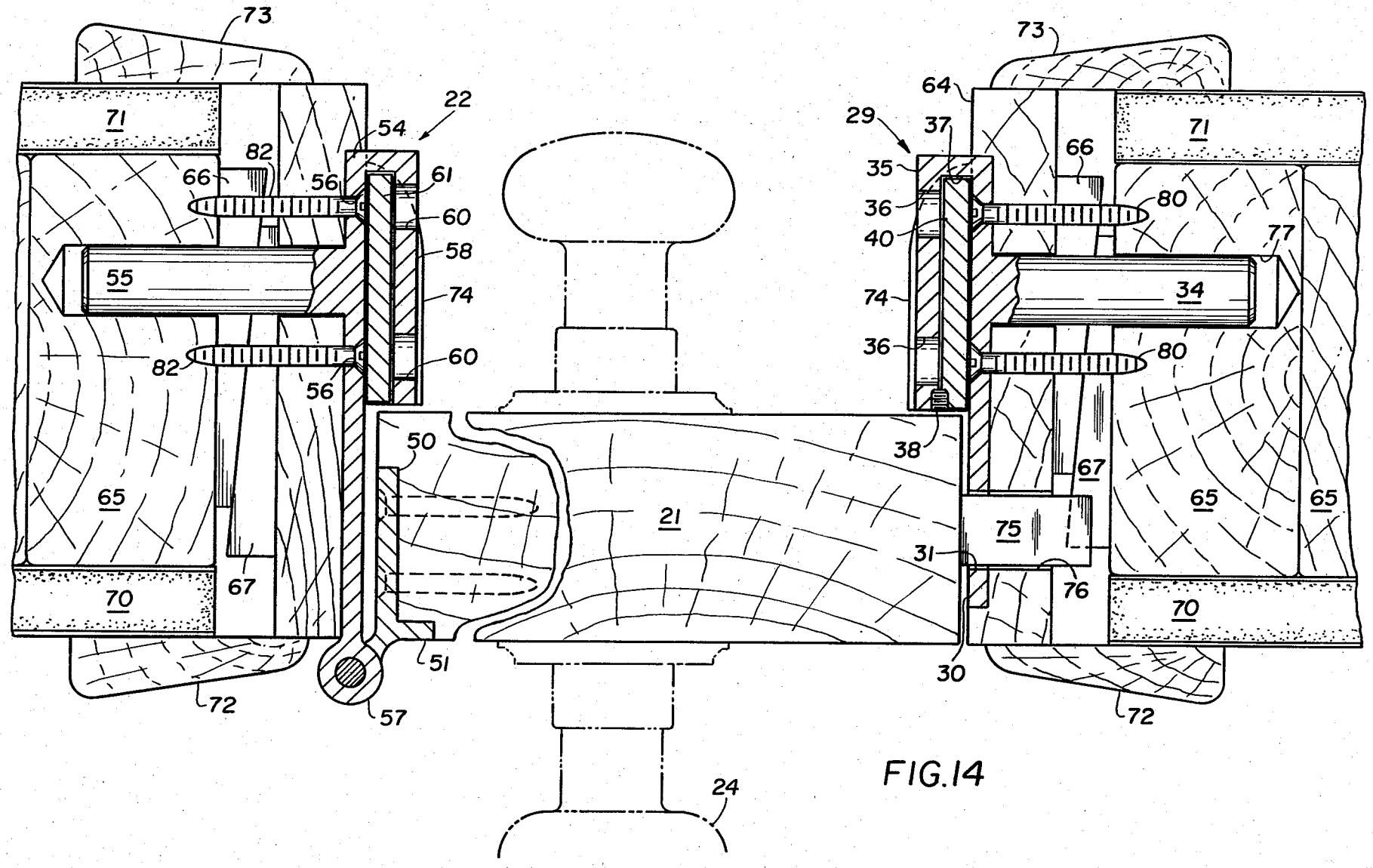
FIG. 14 is a sectional view taken along line 14—14 of FIG. 1.

FIGS. 2 to 6 illustrate a preferred strike plate, and FIGS. 13 and 14 show that plate installed in the door system of FIG. 1. Strike plate 29 comprises a base member 30 that is provided with an aperture 31 through which a dead bolt can project when the strike plate is mounted on a door jamb. Aperture 31 will be sized and shaped depending on the cross sectional area of the dead bolt. Countersunk screwholes 32 are provided to enable the strike plate to be mounted on the door jamb by screws 28 (See FIG. 13). Additional and larger countersunk screwholes 33 are also provided in base member 30 to accommodate longer and more substantial screws that will fasten strike plate 29 to the basic wall structure as shown in FIG. 14. Base member 30 is further provided with an elongated buck pin 34 that is welded to the backside of member 30. Pin 34 is located so as to extend deeply into the central part of the end stud of the wall, or into the masonry in the case of a masonry wall.

Since that part of base member 30 that encompasses screwholes 33 and buck pin 34 would be outside the area protected by a closed door, provision is made to prevent access to the screws passing through screwholes 33 once strike plate 29 is installed. This takes the form of a cover plate 35 which is welded or otherwise secured to base member 30. Plate 35 is provided with apertures 36 which, when plate 35 is welded to member 30, are aligned with screwholes 33. Plate 35 is further provided with a recess 37. The arrangement is such that when strike plate 29 is secured to a door jamb, screws 80 (FIG. 14) are accessible to a screwdriver that projects through apertures 36. Once the strike plate is mounted, a guard plate 40 is inserted into recess 37 thereby blocking further access to screws 80. A set screw 38 threaded into a screwhole common to the inner edge of cover plate 35 and guard plate 40 could be provided to retain the guard plate in recess 37, but as seen in FIG. 14, when door 21 is in the closed position guard plate 40 cannot be removed from recess 37. Thus, screws 80 are secure against unauthorized removal.

Figure 7:
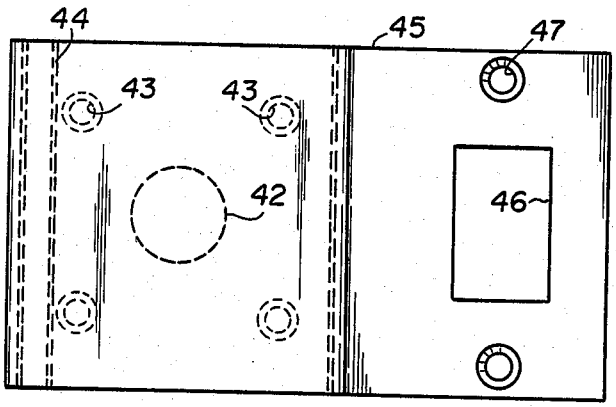
FIG. 7 is a front elevational view of another embodiment of the strike plate.
Figure 10:
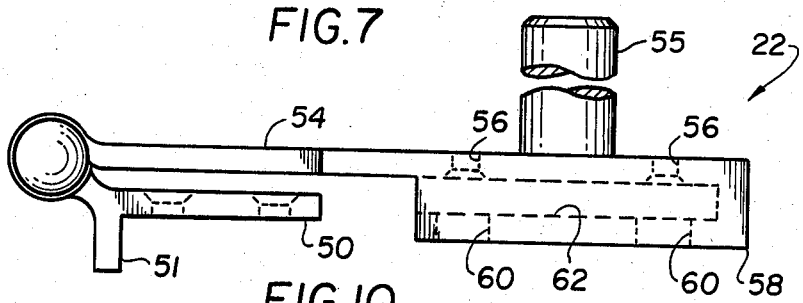
FIG. 10 is a top plan view of the hinge of FIG. 9.
Figure 12:
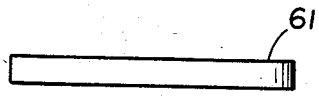
FIGS. 11 and 12, respectively, are a front elevation and a top plan view of a security plate used in conjunction with the hinge.
Figure 9:
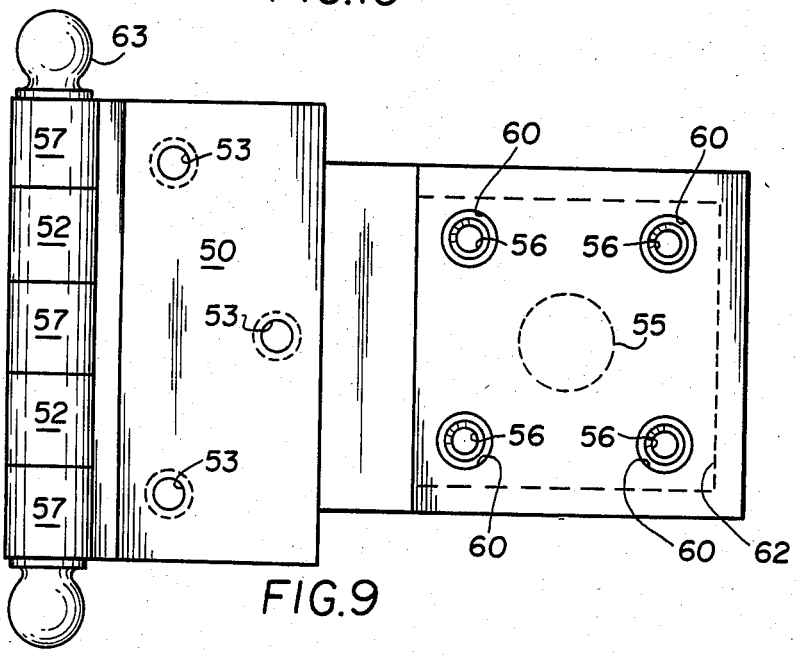
FIG. 9 is a front elevational view of an improved hinge according to the present invention.
Figure 11:
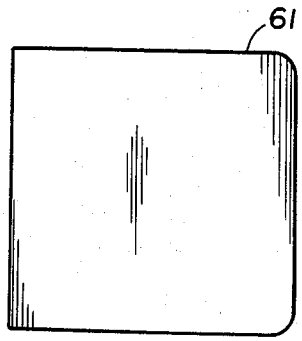

An alternative embodiment of the invention is shown in FIGS. 7 and 8. In this embodiment, a buck pin plate 41, to which buck pin 42 is welded, is provided with screwholes 43 which enable plate 41 to be screw mounted on a door jamb. A dado 44 is formed in plate 41 and a cover plate 45 is engaged in the dado. Cover plate 45 is shaped as shown in FIG. 8 and, when in place, it completely blocks access to the screws that secure plate 41 to a door jamb. Cover plate 45, which is provided with aperture 46 for a lock bolt, is itself secured to a door jamb by screws passing through screwholes 47. Once installed, a closed door blocks access to the screws securing cover plate 45 to a door jamb.

FIGS. 9 to 12 illustrate a door hinge 22 that embodies the buck pin feature already described with respect to strike plate 29. Here, the door leaf 50 is provided with an angle arm 51 that helps prevent door 21 being ripped from leaf 50 when a force is applied to the outside of the door. Leaf 50 is also provided with the usual screwholes 53 and door leaf barrels by which the door leaf is joined to the jamb leaf. The jamb leaf 54 is extended to provide a buck pin portion to which buck pin 55 is welded. Leaf 54 is extended so that pin 55 can project into an aperture provided in the center of the two by four's forming the structural support for the wall. As in strike plate 29, jamb leaf 54 is provided with screwholes 56 through which screws pass to secure hinge 22 to a door jamb. Leaf 54 is also provided with leaf barrels 57 and cover plate 58. Cover plate 58 is provided with access apertures 60, aligned with screwholes 56, which enable a screwdriver to drive screws through screwholes 56 to secure the hinge to a door jamb. Once the hinge is thus secured, a guard plate 61 is slipped into recess 62 formed in cover plate 58. With leaves 50 and 54 secured to the door and the door jamb, respectively, the door is hung and barrel pin 63 is passed through barrels 52 and 57 to pivotally connect the two leaves to form a hinge. As in the case of strike plate 29, a closed door prevents guard plate 61 being removed from recess 62. A set screw (not shown) similar to retaining screw 28 could be provided to retain plate 61 in recess 62.

It is to be understood that a hinge construction similar to that employed in the FIGS. 7 and 8 strike plate embodiment could be used instead of the hinge structure disclosed.

The installation and use of improved hinge 22 and improved strike plate 29 is best illustrated in FIG. 14. The door jamb to which strike plate 29 is secured comprises a door frame member 64 which is nailed (nails not shown) to the end stud 65 of the wall adjacent the door opening. Generally, this last stud comprises a double two by four for added strength around the opening. Other type wall structures, such as masonry walls, may be found in some apartments, but the improved hinge and strike plate of the present invention may be used on door frames set in such walls. The buck pins would simply project into apertures provided in the masonry instead of into apertures provided in a two by four stud.

Frame member 64 is spaced from the stud, or masonry, by a pair of tapered spacing pieces 66 and 67 which enable member 64 to be located to provide the proper door opening width. The inner wall 70 and the outer wall 71 are shown as sheetrock panels. Molding strips 72 and 73 are also illustrated, as is door stop strip 74 against which door 21 normally abuts when in a closed position.

Of course, strike plate 29 will be located depending on where dead bolt 75 will enter the door frame. At that position, a bolt receiving aperture 76 will be provided in frame member 64. Strike plate 29 is aligned such that aperture 31 in base member 30 aligns with aperture 76. Such alignment also determines where hole 77 is provided in frame member 64 and stud 65 to receive buck pin 34. A notch is cut in door stop strip 74 and frame member 64 so that strike plate 29 can be mounted with the inner part of its base member 30 flush with the surface of member 64. As noted earlier, small screws 28 will be threaded into frame member 64 while heavier screws 80 will be threaded through member 64 and into stud 65. After screws 80 are driven, guard plate 40 will be inserted into recess 37 and secured by set screw 38, if provided.

On the hinge side of door 21, it will be seen that hinge 22 provided with buck pin 55 also materially strengthens that side of the door and, for all intents and purposes, eliminates the possibility of forcing the door open on the hinge side by ripping the hinge screws from the door jamb.

It will be clear from the drawing that with the strike plate and the hinge disclosed, it would be virtually impossible to force the door open by applying a force against the outside of the door since buck pins 34 and 55 are well embedded in the wall studs.

Figure 15:
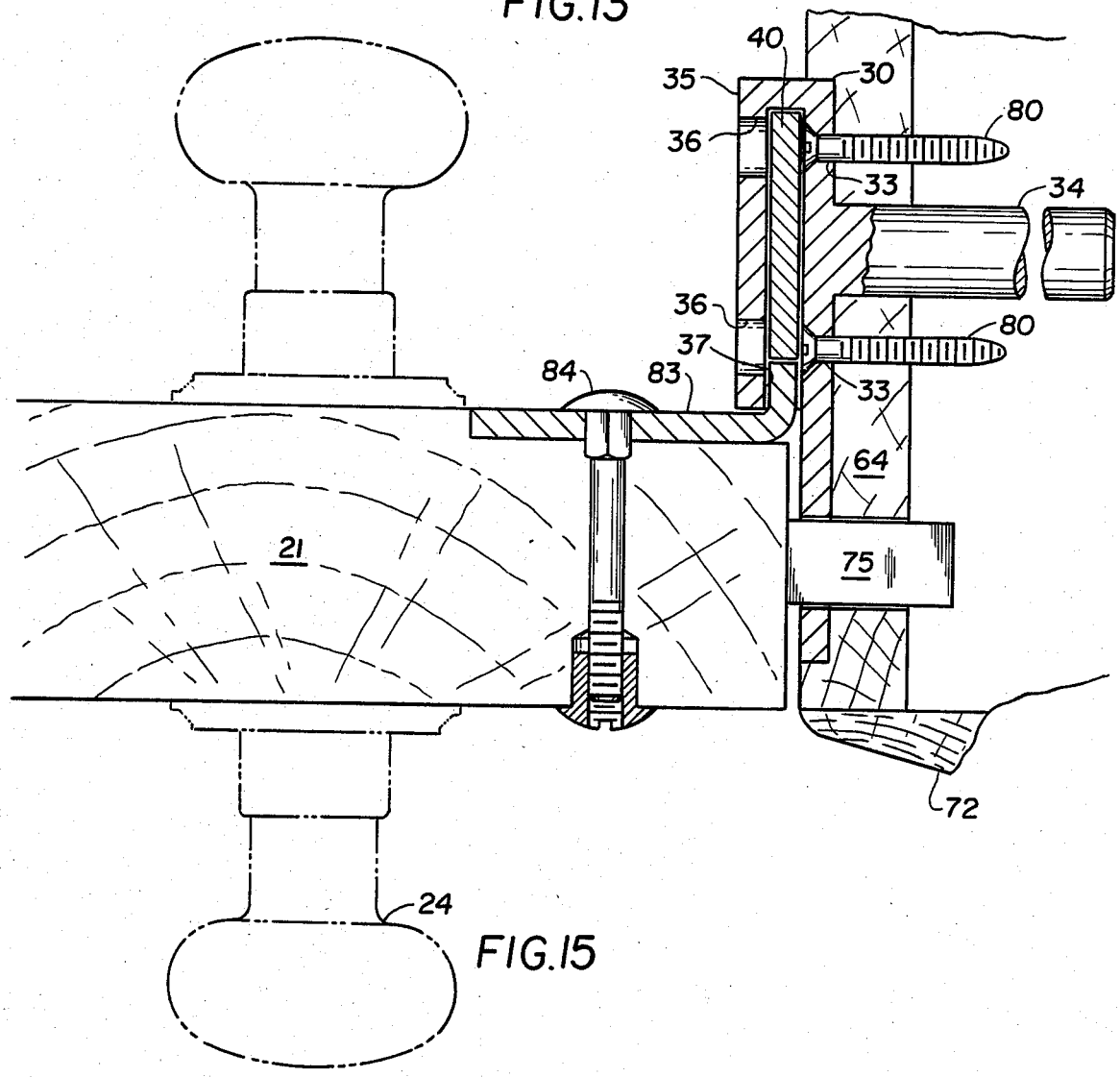
FIG. 15 is a sectional view illustrating an additional security feature of the invention.

One further modification that may be made to increase the security offered by door 21 is to mount an angle iron 83 to the outside edge of the door. See FIG. 15. Angle iron 83 will be fastened to door 21 by at least two carriage bolts, one of which is illustrated. The bent end of angle iron 83 fits into recess 37 formed in cover plate 35 of strike plate 29. Angle iron 83 thus prevents the insertion of a crowbar or other jimmying tool between the edge of the door and the door frame in the vicinity of bolt 75. Also, since the bent end of angle iron 83 extends into recess 37, frame member 64 cannot be bent away from the edge of the door so as to free bolt 75.

Having thus described the invention, it is to be understood that many apparently different embodiments thereof can be made without departing from the spirit and scope of the invention. For example, strike plates and hinges having more than one buck pin could be used. Also, a bar can be angled downwardly from a socket provided on the strike plate to a floor socket inside the door. The strike plate can be adapted for different types of locks such as mortise locks and rim deadbolts. It may also be provided with a bolt box. Therefore, it is intended that the foregoing specification and the accompanying drawing be interpreted as illustrative rather than in a limiting sense.

What is claimed is:

1. A high security strike plate for a door structure in which a door opening in a wall is framed by a door jamb secured to a supporting wall structure and is closed by a door that abuts a door stop mounted on the door jamb and in which the strike plate is secured to the door jamb to cooperate with the bolt of a door mounted lock, said strike plate comprising a base member having a bolt engaging aperture portion adapted to align with the edge of a closed door and a portion extending outwardly beyond the outer surface of a closed door, said extending portion being provided with perpendicularly disposed buck pin means that are offset from said aperture portion so as to project from said base member through a door jamb into a supporting wall structure, said extending portion further being provided with screwholes through which screws may be driven to secure said strike plate to a supporting wall structure, a cover plate secured in spaced relationship to the extending portion of said base member to form a three sided recess which is open towards the aperture portion of said base member but which is closed by the outer surface of a closed door, said cover plate being provided with apertures aligned with the screwholes in said extending portion to permit a screwdriver to be inserted through said apertures to drive screws through said screwholes, and a guard member slidable into said recess to block access to screws that secure said strike plate to the wall structure.

2. A high security strike plate for a door structure in which door opening in a wall is framed by a door jamb secured to a supporting wall structure and is closed by a door that abuts a door stop mounted on the door jamb and in which the strike plate is secured to the door jamb to cooperate with the bolt of a door mounted lock, said strike plate comprising a plate member provided with perpendicularly disposed buck pin means and screwholes whereby said plate member can be secured to a door jamb outside the outer surface of a closed door with said buck pin means projecting into the wall structure by screws extending into the wall structure, said plate member having a dado formed therein so as to form a vertical recess when said plate member is mounted on a door jamb, and a cover plate means for overlaying said plate member to clock access to the screwholes thereof, said cover plate means having a first portion for overlaying said plate member formed with a hook shaped end to engage the recess thereof and a second portion adapted to align with the edge of a closed door, said second portion being provided with a bolt engaging aperture and screwholes through which said cover plate means can be secured to the door jamb.

3. A strike plate according to claim 1 including retaining means for retaining said guard member in the recess provided by said cover plate.

* * * * *